US006416358B1

(12) United States Patent
Kamarauskas et al.

(10) Patent No.: US 6,416,358 B1
(45) Date of Patent: Jul. 9, 2002

(54) SHIELDED ELECTRICAL CONNECTOR FOR MOUNTING ON A PRINTED CIRCUIT BOARD

(75) Inventors: Michael Kamarauskas, Bloomingdale; Yan Margulis, Buffalo Grove, both of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/840,276

(22) Filed: Apr. 23, 2001

(51) Int. Cl.[7] ..... H01R 13/648
(52) U.S. Cl. ..... 439/607
(58) Field of Search ..... 439/607, 95, 108, 439/79, 676

(56) References Cited

U.S. PATENT DOCUMENTS

| | | | | | |
|---|---|---|---|---|---|
| 4,838,811 | A | | 6/1989 | Nakamura et al. | 439/607 |
| 5,017,156 | A | * | 5/1991 | Sugiyama | 439/607 |
| 5,083,945 | A | * | 1/1992 | Miskin et al. | 439/607 |
| 5,125,853 | A | | 6/1992 | Hashiguchi | 439/607 |
| 5,161,999 | A | | 11/1992 | Broschard, III et al. | 439/567 |
| 5,195,911 | A | | 3/1993 | Murphy | 439/607 |
| 5,266,038 | A | * | 11/1993 | Nakamura | 439/607 |
| 5,378,172 | A | | 1/1995 | Roberts | 439/607 |
| 5,686,739 | A | | 11/1997 | Davis et al. | 439/607 |
| 5,702,271 | A | | 12/1997 | Steinman | 439/676 |
| 5,879,194 | A | * | 3/1999 | Thenaisie et al. | 439/607 |
| 5,908,331 | A | | 6/1999 | Hsu et al. | 439/607 |
| 5,980,320 | A | * | 11/1999 | Slack et al. | 439/607 |
| 5,984,725 | A | * | 11/1999 | Belopolsky et al. | 439/607 |
| 5,993,258 | A | * | 11/1999 | Matsunuma et al. | 439/607 |
| 6,007,381 | A | * | 12/1999 | Ando et al. | 439/607 |
| 6,299,480 | B1 | * | 10/2001 | Xu et al. | 439/607 |

* cited by examiner

*Primary Examiner*—Gary Paumen
*Assistant Examiner*—Felix O. Figueroa
(74) *Attorney, Agent, or Firm*—Stephen Z. Weiss

(57) ABSTRACT

A shielded electrical connector is provided for mounting at least partially in a cut-out portion of a printed circuit board. The connector includes a dielectric housing having an opening through a bottom wall thereof coincident with the cut-out portion of the printed circuit board. The housing has a plug-insertion cavity with an opening at a front mating face thereof for receiving a complementary mating plug connector. A latch projection extends from the housing near the opening in the bottom wall thereof. A metal shield is mounted about the housing and has a front plate portion juxtaposed over the front mating face of the housing and having a plug-insertion opening aligned with the front opening of the housing. The shield includes a bottom plate portion aligned with the opening in the bottom wall of the housing and including a latch aperture for embracing the latch projection of the housing.

2 Claims, 4 Drawing Sheets

SHIELDED ELECTRICAL CONNECTOR FOR MOUNTING ON A PRINTED CIRCUIT BOARD

FIELD OF THE INVENTION

This invention generally relates to the art of electrical connectors and, particularly, to a shielded electrical connector for mounting in a cut-out portion of a printed circuit board.

BACKGROUND OF THE INVENTION

Generally, a shielded electrical connector includes some form of dielectric housing mounting a plurality of conductive terminals. The housing may be molded of plastic material, for instance. In order to protect the circuitry on the board, upon which the connector is attached, from electromagnetic interference (EMI) and/or radio frequency interference (RFI), the connector housing may be surrounded by a metal shield or shell. For instance, the shield may be stamped and formed of conductive sheet metal material. When the connector is mounted on a printed circuit board, the external shield typically is grounded to appropriate grounding circuit traces on the circuit board. A typical shielded electrical connector of this type is a modular jack connector which receives a mating modular jack plug.

When a modular jack connector, for instance, is mounted onto the top surface of a printed circuit board, the external metal shield typically covers the top and four sides of the connector housing, with an opening in the shield at the front side or mating face of the connector for receiving the mating modular jack plug. The shield does not cover the bottom of the connector housing, because protection is provided by the bottom wall of the housing particularly in conjunction with the printed circuit board, itself. With the ever-increasing miniaturization of electronic circuitry with which such connectors are employed, the overall size of the connectors, particularly the height of the connectors, continues to be reduced. One miniaturizing design is to mount the connector in a cut-out portion of the printed circuit board. However, this causes problems in providing shielding for the bottom of the connector. Heretofore, the stamped and formed metal shield has been provided with a bottom wall portion coincident with the cut-out portion of the printed circuit board. The bottom wall of the shield may be insertable into a slot in the bottom of the connector housing. Unfortunately, such tab/slot arrangements cause problems because the tabs can easily slip out of the slots, and the bottom wall of the shield can easily move away from the housing, such as if the bottom wall is caught on an extraneous object. In addition, the tabs can slip out of the slots if a force is placed on the bottom wall of the shield causing the wall to bow. To prevent such bowing, raised support ribs have been added to the connector housing at the edges of an opening in the bottom wall of the housing. Unfortunately, such support ribs result in increasing the dimensions of the connector housing. The present invention is directed to solving this myriad of problems in shielding an electrical connector mounted in a cut-out portion of a printed circuit board.

SUMMARY OF THE INVENTION

An object, therefore, of the invention is to provide a new and improved shielded electrical connector for mounting on a printed circuit board.

Another object of the invention is to provide a new and improved connector of the character described for mounting at least partially in a cut-out portion of the printed circuit board.

In the exemplary embodiment of the invention, the connector includes a dielectric housing have a bottom surface for mounting on the printed circuit board and a front mating face. A plug-insertion cavity is formed in the housing communicating with an opening at the front mating face for receiving a complementary mating plug connector. The cavity has an opening through a bottom wall of the housing coincident with the cut-out portion of the printed circuit board. A latch projection extends from the housing near the opening in the bottom wall thereof. A metal shield is mounted on the dielectric housing and has a front plate portion juxtaposed over the front mating face of the housing. A bottom plate portion is aligned with the opening in the bottom wall of the housing. The front plate portion has a plug-insertion opening aligned with the opening at the front mating face of the housing. The bottom plate portion has a latch aperture for embracing the latch projection of the housing.

As disclosed herein, the bottom plate portion of the metal shield is sized to substantially close the opening in the bottom wall of the housing. The bottom plate portion is cantilevered rearwardly from a bottom edge of the front plate portion. The latch projection is located at a rear end of the opening in the bottom wall of the housing, and the latch aperture is located at a free rear end of the bottom plate portion of the shield. The free end of the bottom plate portion is positioned in a slot in the housing at the rear end of the opening in the bottom wall of the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
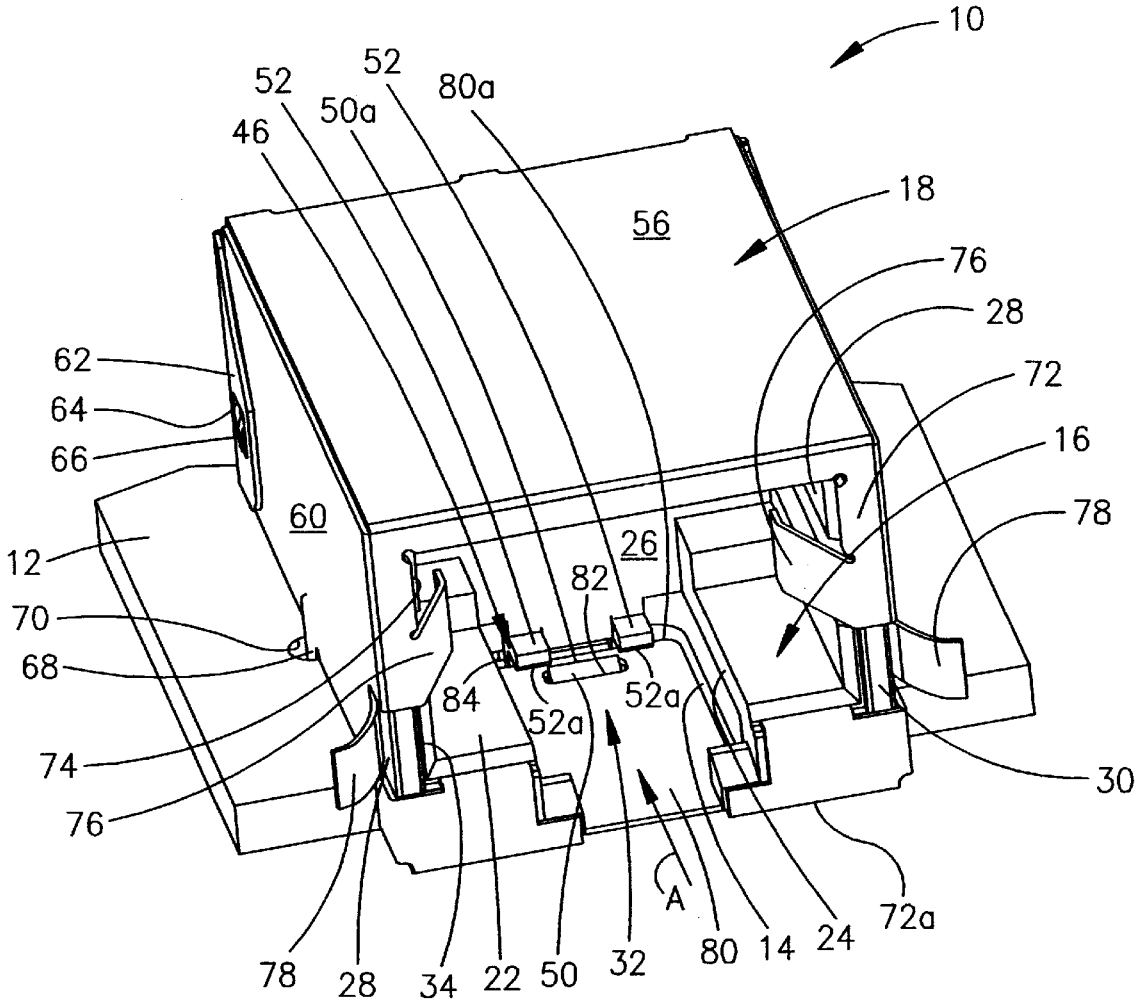
FIG. 1 is a top/front perspective view of a shielded electrical connector according to the invention and mounted on a printed circuit board.
Figure 2:
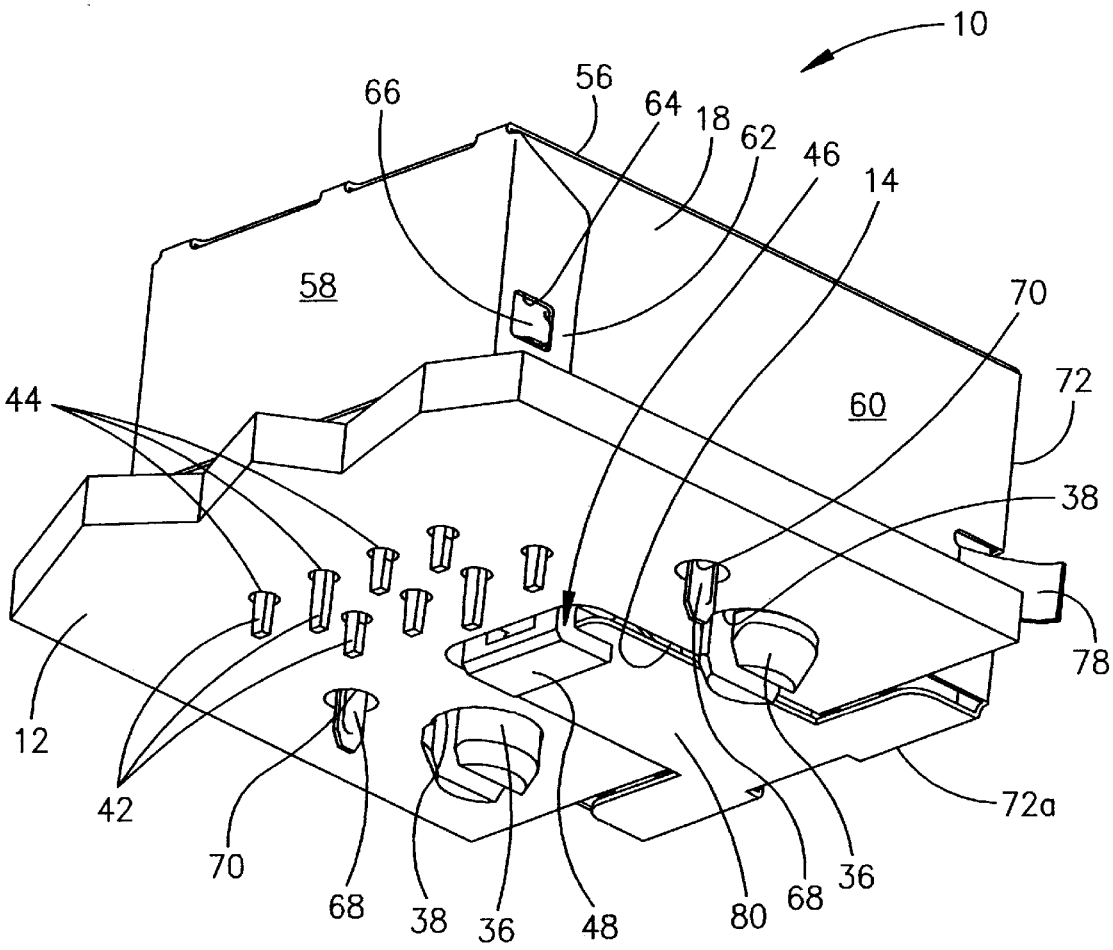
FIG. 2 is a rear/bottom perspective view of the connector mounted on the circuit board.

Referring to the drawings in greater detail, and first to FIGS. 1 and 2, the invention is embodied in a shielded electrical connector, generally designated 10, mounted on a printed circuit board 12. The connector is mounted at least partially in a cut-out portion 14 of the circuit board. The connector includes two basic components, namely a dielectric housing, generally designated 16, and a metal shield, generally designated 18, along with a plurality of electrical terminals mounted on the housing.

Figure 3:
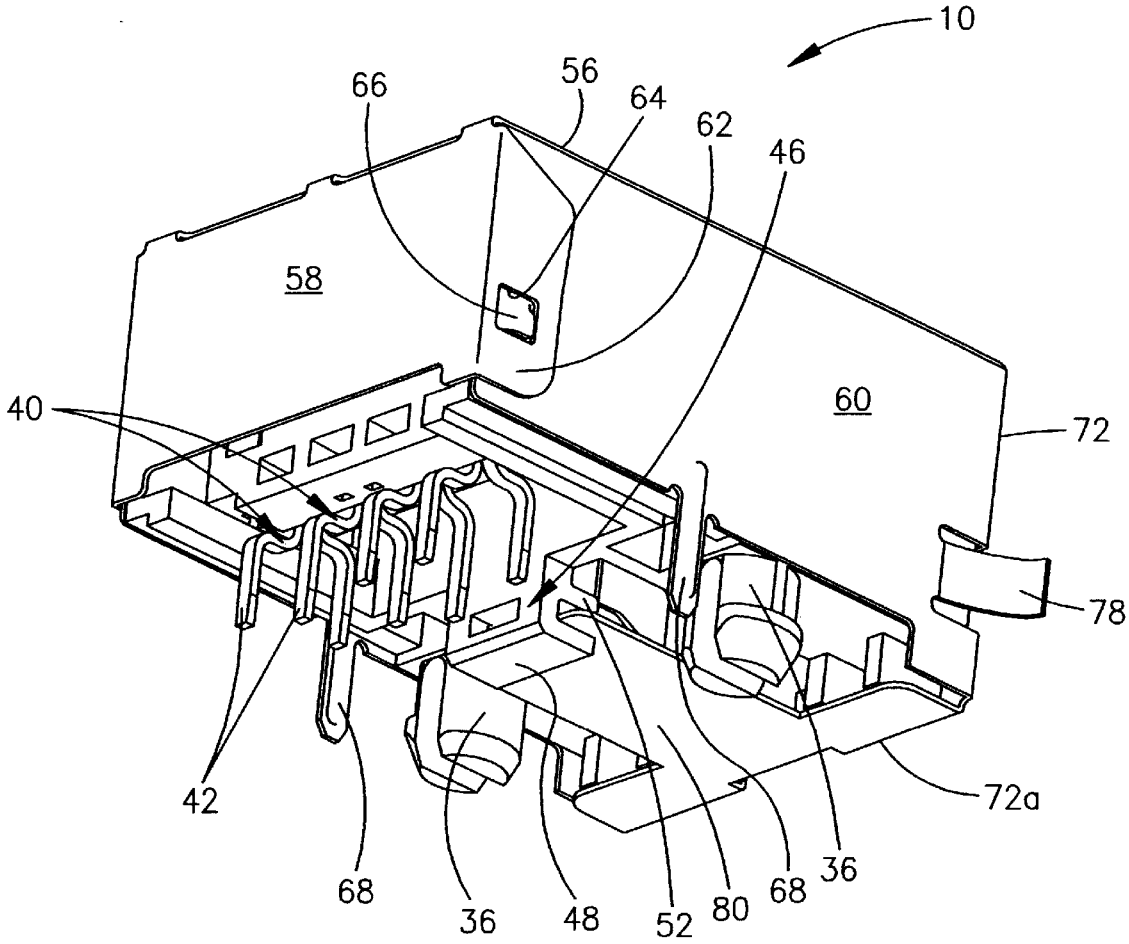
FIG. 3 is a view similar to that of FIG. 2, with the printed circuit board removed to facilitate the illustration.
Figure 4:
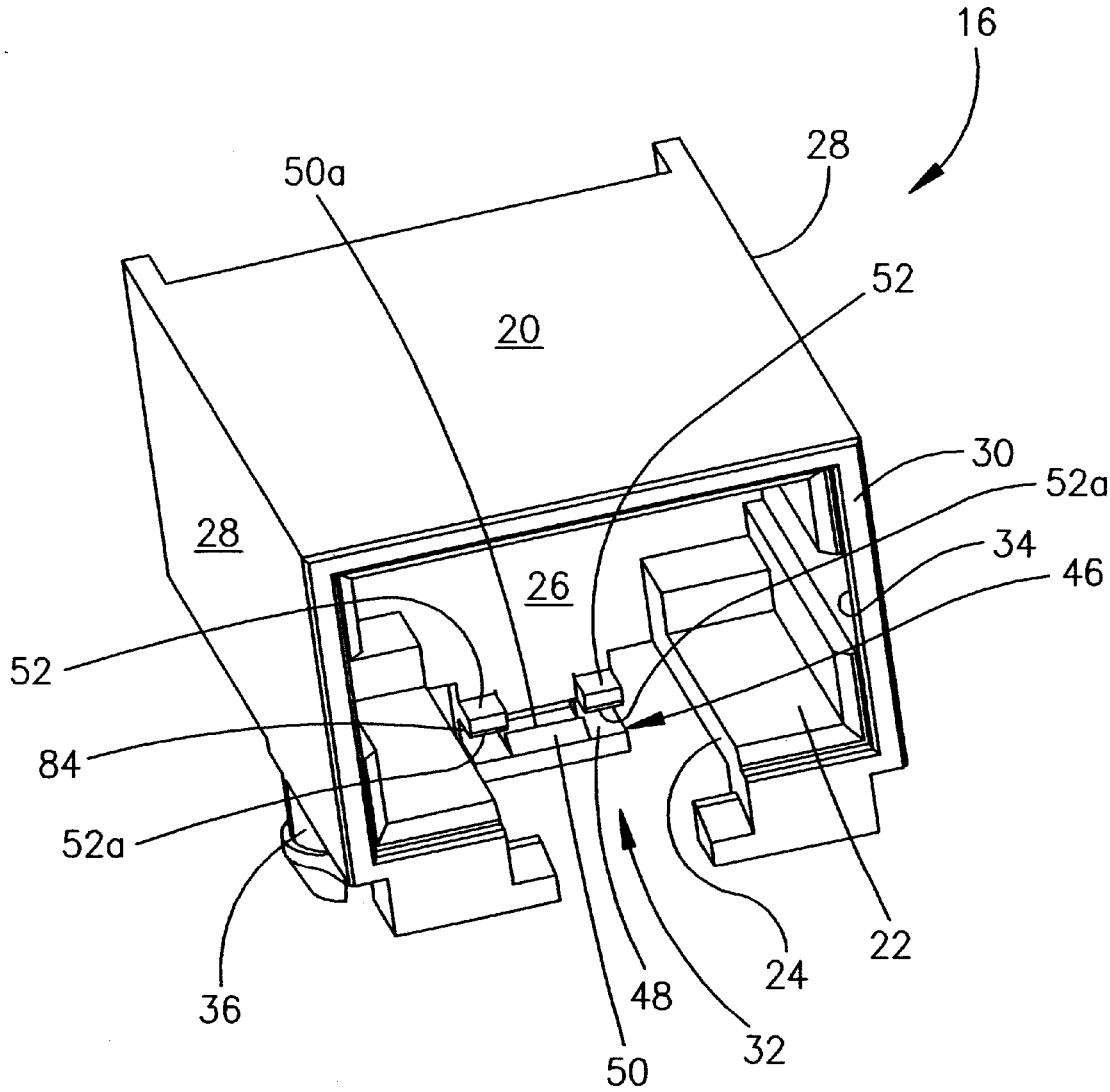
FIG. 4 is a top/front perspective view of the connector housing with the metal shield removed.

More particularly, referring to FIG. 4 in conjunction with FIGS. 1 and 2, dielectric housing 16 of connector 10 is a one-piece structure unitarily molded of plastic material or the like. The housing includes a top wall 20 (FIG. 4), a bottom wall 22 having an opening 24, a rear wall 26 and a pair of opposite side walls 28. The housing has a front mating face 30. Top wall 20, bottom wall 22, rear wall 26 and side walls 28 combine to form a plug-insertion cavity 32 within housing 16, with the cavity communicating with an opening 34 at front mating face 30 for receiving a complementary mating plug connector, such as a modular jack plug. The housing and, thereby, connector 10, is mounted on printed circuit board 12 by a pair of bifurcated mounting posts 36 molded integrally with the housing and insertable into a pair of mounting holes 38 (FIG. 2) in the printed circuit board. The housing mounts a plurality of conductive terminals, generally designated 40 (FIG. 3), which have tail portions 42 for insertion through appropriate holes 44 (FIG. 2) in printed circuit board 12. The tail portions are connected, as by soldering, to appropriate circuit traces on the board and/or in the holes. The terminals have contact portions (not visible in the drawings) exposed within cavity 32 for engaging appropriate contact portions of the terminals of the complementary mating jack plug.

According to the invention, housing 16 of connector 10 includes an integrally molded latching arrangement, generally designated 46, which depends from the bottom of the housing as best seen in FIGS. 3 and 4. The latching arrangement includes a bottom flange 48 having an upwardly projecting latch boss or projection 50. The latch boss or projection is chamfered or ramped upwardly and rearwardly. A pair of stop flanges 52 are spaced from each other outside the opposite side edges of latch boss 50. The bottom front edges 52*a* of stop flanges 52 are chamfered or angled downwardly and rearwardly. An upper rear edge 50*a* of ramped latch boss 50 is parallel with the bottoms of stop flanges 52. The vertical spacing between the top edge of latch boss 50 and the bottom surfaces of stop flanges 52/3 just enough to allow the insertion of the shield, troubled teeth.

Referring back to FIGS. 1–3, shield 18 of connector 10 is stamped and formed of sheet metal material. The shield includes a top wall or plate portion 56 (FIG. 1), a rear wall or plate portion 58 (FIGS. 2 and 3), and a pair of side walls or plate portions 60 all combining to form a generally box-shaped configuration substantially surrounding housing 16 of the connector. Rear wall 58 has a pair of side flanges 62 with openings 64 snappingly engaged about a pair of latch tabs 66 stamped and formed out of side walls 60 to hold the shield in its box-shaped configuration. Each side wall 60 of the shield includes a depending leg portion 68 which is insertable through an appropriate hole 70 in printed circuit board 12. Legs 68 are connected, as by soldering, to appropriate grounding circuit traces on the printed circuit board and/or in the holes to ground shield 18 thereto.

As best seen in FIG. 1, shield 18 includes a front plate portion 72 juxtaposed over front mating face 30 of housing 16. The front plate portion has a plug-insertion opening 74 aligned with opening 34 in the front mating face of the housing for insertion therethrough of the mating modular jack plug. A pair of flexible or spring contact fingers 76 extend into cavity 32 from front plate portion 72 for engaging an external shield or other grounding means or contacts on the mating modular jack plug. A pair of flexible or spring contact fingers 78 project outwardly of front plate portion 72 for engaging a panel (not shown) within which the front of connector 10 may be mounted.

According to the invention, shield 18 of connector 10 includes a bottom plate portion 80 having a latch aperture 82 (FIG. 1) near a free rear end or edge 80*a* of the bottom plate portion. As will be described in greater detail hereinafter, latch aperture 82 embraces ramped latch projection 50 as seen in FIG. 1. Bottom plate portion 80 is sized to substantially close opening 24 in bottom wall 22 of housing 16 and, as seen in both FIGS. 1 and 2, the bottom plate portion fully closes cut-out portion 14 in printed circuit board 12. The bottom plate portion is cantilevered rearwardly from a bottom edge 72*a* of front plate portion 72 of the metal shield.

As seen in FIG. 4, a slot 84 is formed between bottom flange 48 and stop flanges 52 of latching arrangement 46. As seen in FIG. 1, rear edge 80*a* of bottom plate portion 80 of the shield eventually is positioned within slot 84, as described below.

In assembly, metal shield 18 is stamped from sheet metal material as described above, and partially formed to the extent that bottom plate portion 80 can be assembled in the direction of arrow "A" (FIG. 1). In essence, free rear edge 80*a* of the bottom plate portion is inserted into slot 84 of latching arrangement 46. During insertion, the free edge of the bottom plate portion rides upwardly along ramped latch projection 50 and into engagement with chamfered bottom front edges 52*a* of stop flanges 52. With top rear edge 50*a* of latch projection 50 being generally coplanar with the bottoms of stop flanges 52 as described above, the free edge 80*a* of the bottom plate portion bends slightly until latch aperture 82 snaps over latch projection 50, and with free edge 80*a* within slot 84, as seen in FIG. 1. Once so assembled, the bottom plate portion cannot be removed because stop flanges 52 prevent free edge 80*a* of the bottom plate portion from moving above latch projection 50. In essence, during assembly, free edge 80*a* is "squeezed" between ramped latch projection 50 and ramped edges 52*a* as the free edge deforms slightly and returns to its original unstressed state.

After bottom plate portion 80 of shield 18 is assembled as described above, the final bending and forming of the metal shield can be performed, such as closing rear wall 58 and holding the assembly together by latch tabs 66 of side walls 60 within openings 64 of side flanges 62.

It will be understood that the invention may be embodied in other specific forms without departing from the spirit or central characteristics thereof The present examples and embodiments, therefore, are to be considered in all respects as illustrative and not restrictive, and the invention is not to be limited to the details given herein.

What is claimed is:

1. A shielded electrical connector for mounting at least partially in a cut-out portion of a printed circuit board, comprising:

a dielectric housing having a bottom surface for mounting on the printed circuit board and a front mating face, a plug-insertion cavity in the housing communicating with an opening at the front mating face for receiving a complementary mating plug connector, the cavity having an opening through a bottom wall of the housing coincident with the cut-out portion of the printed circuit board, and a latch projection extending from the housing near the opening at a rear end of the bottom wall and in the bottom wall thereof; and a metal shield mounted on the dielectric housing and having a front plate portion juxtaposed over the front mating face of the housing and a bottom plate portion parallel to and located below the bottom surface of the housing and aligned with the opening in the bottom wall of the housing, the front plate portion having a plug-insertion opening aligned with the opening at the front mating face of the housing, and the bottom plate portion having a latch aperture for embracing the latch projection of the housing, said latch aperture being located at a free end of the bottom plate portion of the metal shield, and including stop means on the housing to prevent the bottom plate portion from disengagement of the latch aperture from being embraced by the latch projection.

2. A shielded electrical connector for mounting at least partially in a cut-out portion of a printed circuit board, comprising:

a dielectric housing having a bottom surface for mounting on the printed circuit board and a front mating face, a plug-insertion cavity in the housing communicating with an opening at the front mating face for receiving a complementary mating plug connector, the cavity having an opening through a bottom wall of the housing coincident with the cut-out portion of the printed circuit board, and a latch projection extending from the housing at a rear edge of the opening in the bottom wall thereof; and a metal shield mounted on the dielectric housing and having a front plate portion juxtaposed over the front mating face of the housing and a bottom plate portion cantilevered rearwardly from a bottom edge of the front plate portion and closing the opening in the bottom wall of the housing, the front plate portion having a plug-insertion opening aligned with the opening at the front mating face of the housing, and the bottom plate portion having a latch aperture near a free end thereof for embracing the latch projection of the housing the free end positioned in a slot in the housing adjacent the latch projection where the slot is formed in part by a stop surface which prevents the free end of the bottom plate portion from disengagement of the latch aperture thereof from the latch projection of the housing.

* * * * *